US006561389B1

(12) United States Patent
Earle

(10) Patent No.: US 6,561,389 B1
(45) Date of Patent: May 13, 2003

(54) DISPENSER APPARATUS FOR MEDICAL GRADE ULTRASOUND GEL

(76) Inventor: Walter R. Earle, 4450 - 18th Side Road, RR #2, Pottageville (CA), L0G 1J0

( * ) Notice: Subject to any disclaimer, the term of this patent is extended or adjusted under 35 U.S.C. 154(b) by 52 days.

(21) Appl. No.: 09/917,736

(22) Filed: Jul. 31, 2001

(51) Int. Cl.[7] ..... B67D 5/42
(52) U.S. Cl. ..... 222/388; 222/146.5; 222/263
(58) Field of Search ..... 222/146.5, 510, 222/518, 378, 380, 388, 263

(56) References Cited

U.S. PATENT DOCUMENTS 4,046,291 A * 9/1977 Goda ..... 222/309
5,277,342 A * 1/1994 Dickau et al. ..... 222/387
5,992,695 A * 11/1999 Start ..... 222/137
6,354,471 B2 * 3/2002 Fujii ..... 222/380

* cited by examiner

*Primary Examiner*—Philippe Derakshani
*Assistant Examiner*—Melvin Cartagena
(74) *Attorney, Agent, or Firm*—Marks & Clerk

(57) ABSTRACT

A dispenser apparatus for ultrasound gel comprises a cylindrical body having a closed first end and a dispensing opening at the other end. There is an inlet opening near the first end in fluid communication with a source of pressurized ultrasound gel. A plunger is secured to a shaft near its first end; and there is a valve element at the second end of the shaft, adapted to close the dispensing opening when the shaft is in a first, at rest position, and to permit a dispensing operation when the shaft is in a second, dispensing position. The plunger has at least one passageway formed through its thickness, extending towards a second face. A plunger return spring acts against the second face of the plunger, so as to urge it towards the rest position. A freely moving sealing plate covers the passageway, and is mounted for longitudinal movement along the shaft; and has a return spring to urge it towards the second face of the plunger. The plunger covers the inlet opening when in its first position. A trigger moves the shaft and the plunger against the return springs, and the valve element is moved into the dispensing position away from the dispensing opening. Chambers above and below the plunger are always filled with gel.

11 Claims, 2 Drawing Sheets

DISPENSER APPARATUS FOR MEDICAL GRADE ULTRASOUND GEL

FIELD OF THE INVENTION

This invention relates to dispensers for dispensing medical grade ultrasound gel onto the body of a patient in a region which is to undergo ultrasound examination. In particular, the present invention is directed to such dispensers that effectively preclude cross-contamination whereby pathogens maybe transferred from one patient to the next as a consequence of the use of a common gel dispensing apparatus which is used for more than one patient.

BACKGROUND OF THE INVENTION

The particular purpose of the present invention is to provide a dispensing apparatus which will dispense medical grade ultrasound gel onto the body of a patient in such a manner that the risk of cross-contamination from one patient to the next is effectively precluded; while at the same time the comfort of the patient may be assured by dispensing medical grade ultrasound gel which has been warmed to above ambient or room temperature.

In particular, it is a purpose of the present invention to provide a dispenser for medical grade ultrasound gel which assures that the medical grade ultrasound gel remains uncontaminated in the same condition that it has been received from the manufacturer, until such time as the ultrasound gel is dispensed. At the same time, it is assured that harmful pathogens which might be contacted by the gel dispenser from the body of a patient are not transmitted to another patient.

When ultrasound gel is delivered to the body of the patient, it is typically spread around on the body of the patient in the area which is to receive an ultrasound examination. The purpose of the ultrasound gel is to provide coupling between the ultrasound probe and the body of the patient, since the ultrasound waves are not transmissible through air but require a more dense medium.

Typically, ultrasound gel is relatively costly, so it is desired to be able to dispense only enough gel for the ultrasound procedure to be undertaken, while preserving gel in the dispenser being used for the next ultrasound procedure on another patient. Otherwise, it would be necessary to produce single use ultrasound gel containers, probably of varying sizes depending on the amount of gel to be dispensed for any particular ultrasound procedure, and that suggestion is prohibitively expensive. Accordingly, it is most usual that an ultrasound gel dispenser shall contain more ultrasound gel than is required for any specific procedure, and typically the ultrasound gel dispenser is refillable.

However, when an ultrasound gel bottle is used to prepare a patient, which may be human or a veterinary patient, for an ultrasound procedure, the gel dispenser comes into contact with the body of the patient. Therefore, the gel dispenser maybe exposed to body fluids; and if so, the gel dispenser may become contaminated with pathogens such as bacteria, fungi, parasites, and viruses. Of course, such pathogens may then be transmitted to another patient during a subsequent procedure.

The medical grade ultrasound gel which may be dispensed in keeping with the present invention, and as it is dispensed in the prior art devices being discussed, may have differing viscosities. Typically, a gel which is used for diagnostic procedures is less viscous than a gel which is used for therapeutic ultrasound procedures. The reason is, in particular, that medical grade ultrasound therapeutic gels may be placed on a smaller area of the patient of the body than would typically be the case when an ultrasonic diagnostic procedure is to be carried out.

In any event, there is a concern that pathogens can be transmitted to another patient during a subsequent procedure, particularly if the gel dispenser has been positioned around an open wound for a given procedure. This is of even more concern when a gel dispenser may be used on a patient who is suffering from AIDS, or is otherwise immuno-comprised such as is the consequence of following an immuno-suppression drug regimen.

A recent study by a major hospital in Toronto, Canada, showed that more than 100 different kinds of bacteria may be found on a dispenser used for dispensing medical grade ultrasound gel.

Quite often, such dispensers take the form of a bottle—not unlike a ketchup bottle used in household kitchens and the like—from which the medical grade ultrasound gel is to be dispensed. If so, typically the medical grade ultrasound gel is purchased by the hospital or medical laboratory or veterinary clinic in bulk, and the dispensing bottles are filled every five to ten patients in a typical use experience.

It is usual that such gel bottles are managed by being wiped with an alcohol swab before being refilled from the bulk container, and between patients. However, particularly when the gel bottle is to be refilled, it is typically not completely empty before the new gel is to be introduced into the bottle, and therefore the new gel may be exposed to any contaminants or pathogens that are to be found within the gel dispensing bottle. This is because the bottle has only been wiped around the exterior of the cap area and not the interior of the cap or the interior of the bottle. Moreover, the process of refilling the ultrasound gel dispenser bottles is labour intensive, time consuming, difficult, and therefore costly, and it does not fully address or typically ignores the contamination problem. Even if a cleaning and disinfectant procedure has been followed, it is not always effective because it may be possible that the interior of the bottle is not clean.

The present invention presupposes the availability of a source of pressurized medical grade ultrasound gel, to which the dispenser of the present invention is connected in fluid communication with that source. However, the details of the pressurized source of medical grade ultrasound gel are beyond the scope of the present invention.

Moreover, by being in fluid communication with a pressurized source of medical grade ultrasound gel, the assurance is given that each time ultrasound gel is dispensed using the dispensing apparatus of the present invention, the dispensed volume is replaced from the external source of pressurized medical grade ultrasound gel. This assures that the gel remains uncontaminated, because there is no necessity to open the dispenser; and as will be discussed hereafter, there is no opportunity for pathogens to transfer from a patient into the dispenser because of the structure of the dispenser and also because typically a disposable cap member is employed. As will be discussed hereafter, the cap member is very inexpensive, and thus a new, sterilized or at least antiseptic cap member may be used each time the medical grade ultrasound gel is to be dispensed onto a new patient.

The present inventor has quite unexpectedly discovered that a structure for a dispenser apparatus for use in dispensing medical grade ultrasound gel onto the body of a patient, which assures hygienic conditions with respect to the medical grade ultrasonic gel until such time as it is dispensed onto the body of a patient, may be provided using a closed container having a plunger and a sealing plate which will eject the ultrasound gel from the dispensing apparatus while, at the same time, assuring that the dispensing apparatus is refilled from a source of pressurized medical grade ultrasound gel.

Because of the structure of the ultrasound gel dispensing apparatus, particularly when a cap member is employed on the apparatus, contamination of the interior of the dispenser apparatus is precluded. Additional features of the present invention optionally allow for the medical grade ultrasound gel to be heated to above ambient or room temperature, and particularly provide for the use of disposable cap members having significantly low unit costs.

Accordingly, medical grade hydraulic gel dispensers are provided by the present invention which promote at least hygienic and antiseptic conditions, preclude cross-contamination between patients, and assure comfort to the patient by dispensing ultrasound gel which has been warmed.

DESCRIPTION OF THE PRIOR ART

Kozam U.S. Pat. No. 4,575,375, issued Mar. 11, 1986, teaches a dispensing apparatus which essentially squeezes medication out of a tube, so that an individual patient may self-administer the medication or irrigant into periodontal pockets. Preferably, the medication is in the form of a gel. The operation is, however, not unlike an automated dispensing of toothpaste from a tube thereof.

Frass et al U.S. Pat. No. 4,844,080, teaches an ultrasound contact medium dispenser—ultrasound gel—which pumps gel from a reservoir through a tube to a valve from which the gel is dispensed at the same time that a probe is manipulated. The delivery tube may pass through an electrically powered heater.

A device which is particularly intended for use with ophthalmic gel is taught in Vlasich U.S. Pat. No. 5,048,727, issued Sep. 17, 1991. Here, a single unit dose dispenser is provided, which is coupled with a compressible container that is filled with a gas propellant. When it is desired to dispense the predetermined dose, external pressure is applied to the outer surface of the compressible container having the gas propellant within it, so as to expel the coupling composition. The tube in which the gel is contained is equipped with a removable cap, which is removed just prior to the dispensing procedure so as to preserve the sterility of the gel. Obviously, this apparatus is expensive, since it provides for a predetermined quantity, and is single use.

A paste or gel dispenser is provided in Loudon, U.S. Pat. No. 5,145,095, issued Sep. 8, 1992. Typically, this complicated dispenser is intended for use with toothpaste, and provides a pair of non-return valves which creates an airtight seal with a tube of toothpaste. First, a cavity within the dispenser is primed by squeezing the tube of toothpaste, and then a spring-loaded plunger is activated to displace the toothpaste from the dispensing cavity. As the spring pushes the plunger back, toothpaste is expelled through a second non-return valve onto the bristles of a toothbrush. At the same time, the vacuum which occurs in the dispensing cavity causes further dispensing of toothpaste from the tube into the dispensing cavity for the next toothpaste dispensing procedure.

Last et al U.S. Pat. No. 5,819,986, issued Oct. 13, 1998, provides a dispenser for liquid, gel, granular, or powdered media where a pump outlet is connected to a spray nozzle, and via a suction tube to a connector tube. The refill packing includes an integrally manufactured connector that can be pressed onto the connector tube, and which opens the connector so as to communicate to the interior of the refill packing. The intent is to provide a dispenser that will assure leak-free connection of the refill packing within the outer container therefor.

Hertel U.S. Pat. No. 6,009,887, issued Jan. 4,2000, teaches an adjustable applicator for liquids or gels, medicines or lotions, and the like, which has a pivotal head so that the material to be dispensed may be dispensed on a difficult to reach location such as the user's back. A pad is provided on the applicator head, and either a lotion is dispensed through the pad, or the pad is pre-soaked with the lotion or gel to be applied. The apparatus may also be used to apply medications or lotions or gels to animals.

SUMMARY OF THE INVENTION

The present invention provides a dispenser apparatus for dispensing medical grade ultrasound gel onto the body of a patient in a region which is to undergo ultrasound examination. The dispenser apparatus has a generally cylindrical body having a closed first end and a distal second end which has a dispensing opening therein. A cylinder axis extends along the length of the body.

There is an inlet opening into the interior of the body near the first end thereof, the inlet opening being in fluid communication with a source of pressurized medical grade ultrasound gel.

An elongated shaft extends along the cylinder axis, and has a plunger which is secured thereto near a first end of the shaft, so that the plunger is located near the first end of the body.

A valve element is located at the second end of the shaft, which is remote from the first end. The valve element is adapted to close the dispensing opening when the shaft is in a first, at rest position, and to be in a dispensing position away from the dispensing opening of the body when the shaft is in a second, dispensing position.

The plunger has a first face which faces the first end of the body, and a second face which faces the dispensing opening. There is at least one passageway formed through the thickness of the plunger, so as to extend through the height of the plunger from the first face to the second face thereof.

A plunger return spring is mounted within the body, and it extends between a first fix return spring seat secured within the interior of the body, and the second face of the plunger. The plunger return spring is adapted to urge the plunger from a second position when the shaft is in the second dispensing position towards a first position, whereby the shaft and the plunger secured thereto will assume the first rest position.

There is also a freely moving sealing plate which is mounted for longitudinal movement along the shaft between a first position adjacent the second face of the plunger and a second position which is remote therefrom. The second sealing plate position is below and adjacent to the second face of the plunger.

A sealing plate return spring is also mounted within the body, and it extends between a second fixed return spring seat which is also secured within the interior of the body, and the second face of the sealing plate which is remote from the second face of the plunger. The sealing plate return spring is adapted to urge the sealing plate from a second position near the second fixed return spring seat towards a first position which is adjacent the second face of the plunger.

The sealing plate is adapted to cover the at least one passageway formed in the plunger, when the sealing plate is urged into its first position adjacent the second face of the plunger.

The plunger is adapted to cover the inlet opening when the plunger is in the first, rest position.

Trigger means are provided which are adapted to move the shaft and the plunger from the first position to the second position against the plunger return spring and against the sealing plate return spring. Thus, the valve element is moved into the dispensing position away from the dispensing opening.

Typically, there are a plurality of passageways that are formed through the plunger from the first face to the second face thereof. If so, the sealing plate is adapted to cover the plurality of passageways when it is urged into its first position which is adjacent the second face of the plunger.

Also, typically the second end of the body is configured so as to have an outwardly directed protrusion through which the medical grade ultrasound gel is dispensed when the valve element is moved into its dispensing position. The dispensing opening is formed, therefore, at the end of the outwardly directed protrusion.

When the body of the dispensing apparatus of the present invention has the outwardly directed protrusion, there is typically further provided a cap member which has two axially located open ends opposite each other. The cap member is separable from the body, and is adapted to be fitted to the outwardly directed protrusion. Accordingly, when the cap member is in place, the medical grade ultrasound gel is dispensed through the cap member when the valve element is moved into its dispensing position.

The cap member may be adapted to be threadably secured to the outwardly directed protrusion by cooperating threads which are formed exteriorly on the protrusion and interiorly on the cap member. Also, the cap member may be adapted to be snap fitted to the outwardly directed protrusion.

Typically, a pair of sealing rings is fitted to the outside periphery of the plunger. If so, one of the sealing rings is positioned above the inlet opening and the other of the sealing rings is positioned below the inlet opening, when the plunger is in its first, rest position.

The source of pressurized medical grade ultrasound gel with which the inlet opening is in fluid communication is typically pressurized to within the range of 40 psi to 100 psi.

A check valve may be installed in the fluid conduit which extends from the inlet opening to the source of pressurized medical grade ultrasound gel, thus precluding outflow of ultrasound gel through the inlet opening.

A gel warmer fitment may be adapted to receive the outwardly directed protrusion on the body of the dispensing apparatus, so as to transfer heat from the gel warmer fitment into the medical grade ultrasound gel at least within the body in the region of the dispensing opening.

Usually, therefore, when the medical grade ultrasound gel within the body of the dispensing apparatus of the present invention is warmed, an insulating layer is provided to surround the body.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

The novel features which are believed to be characteristic of the present invention, as to its structure, organization, use and method of operation, together with further objectives and advantages thereof, will be better understood from the following discussion.

Figure 1:
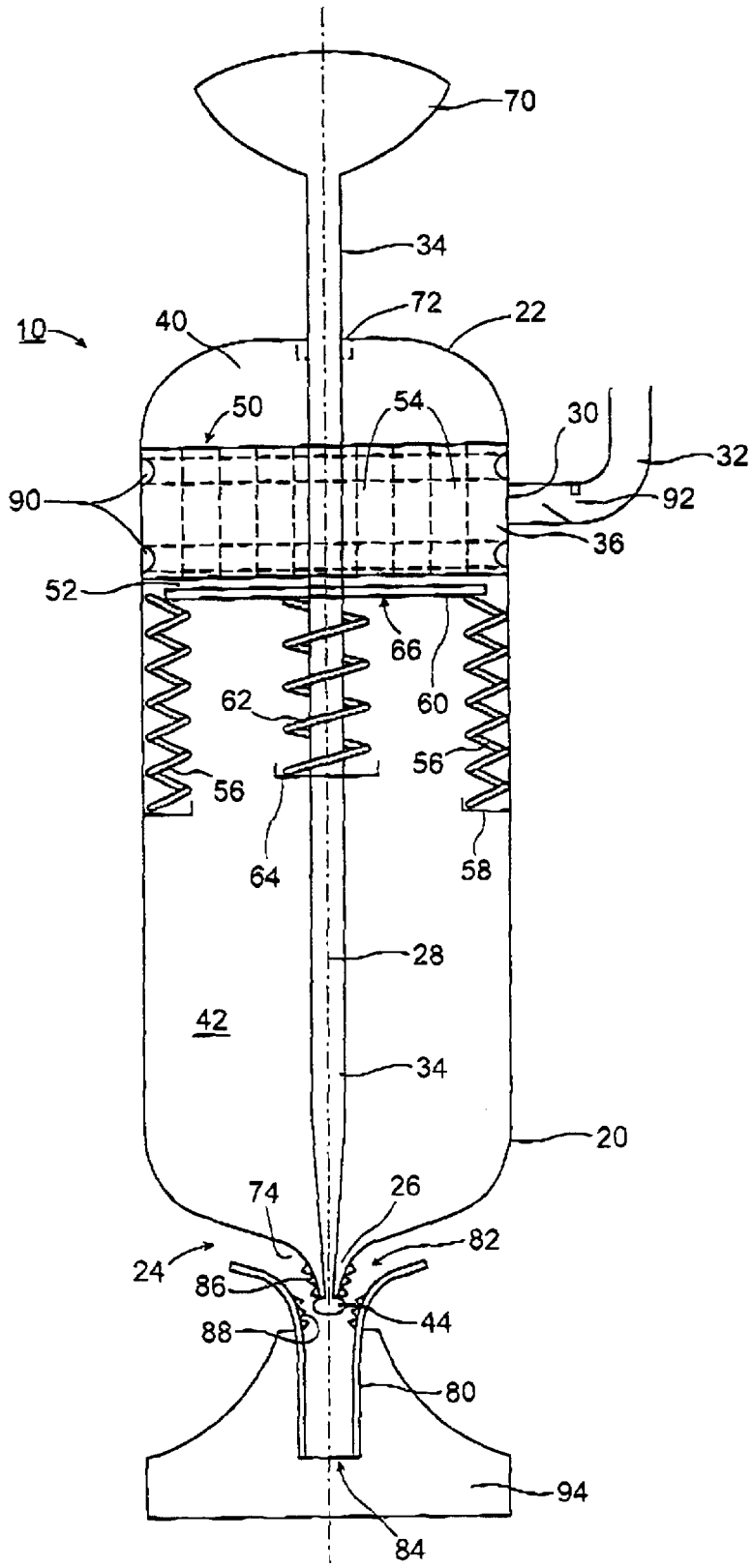
FIG. 1 is a cross-sectional view of the dispenser apparatus in keeping with the present invention, with the shaft and plunger being found in their first, rest position.
Figure 2:
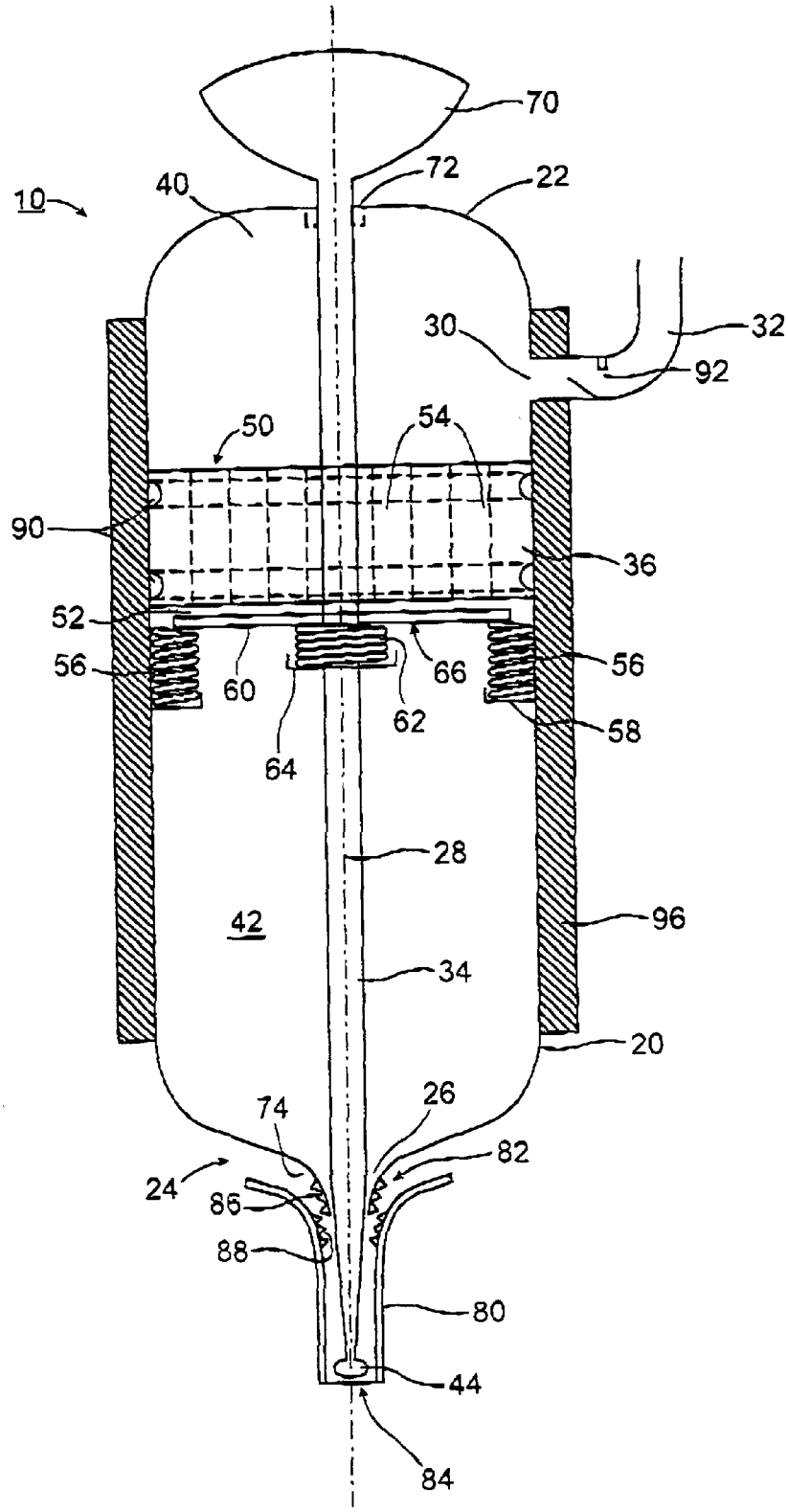
FIG. 2 is a view similar to FIG. 1 with the shaft and plunger being found in a second, dispensing position.

The dispenser apparatus for dispensing medical grade ultrasound gel, in keeping with the present invention, is shown at 10 in each of FIGS. 1 and 2. First, the structure of the dispenser apparatus will be discussed, followed by an explanation of its operation.

A generally cylindrical body 20 is provided, having a closed first end 22 and a distal second end 24 which has a dispensing opening 26 therein. A cylindrical axis 28 extends along the length of the body 20.

An inlet opening 30 is formed into the interior of the body 20, near the first end 22. The inlet opening 30 is in fluid communication by way of a conduit 32 with a source of pressurized medical grade ultrasound gel (not shown).

There is an elongated shaft 34 which extends along the cylinder axis 28. A plunger 36 is secured to the shaft 34 near the first end thereof, so as to be located near the first end 22 of the body 20. It will be seen that two chambers, designated 40 and 42, are formed within the interior of the body 20, the first chamber 40 being above the plunger 36, and the second chamber 42 being below the plunger 36. As will be described hereafter, each of chambers 40 and 42 are always filled with medical grade ultrasound gel.

There is a valve element 44, which may typically be considered to be such as a ball valve, and it is formed at the second end of the shaft 34. As seen in FIG. 1, the valve element 34 is adapted to close the dispensing opening 26 when the shaft is in a first, at rest position as shown in FIG. 1. However, when the shaft is in a second, dispensing position as shown in FIG. 2, then the valve element 44 is located in a dispensing position which is away from the dispensing opening 26, as clearly seen in FIG. 2.

The plunger 36 has a first face 50 and a second face 52. The first face 50 faces the first end 22 of the body 20, and the second face 52 faces the dispensing opening 26. There is at least one passageway 54 which is formed through the thickness or height of the plunger 36, and extends therethrough from the first face 50 to the second face 52.

A plunger return spring 56 is mounted within the interior of the body 20, and it extends between a first fixed return spring seat 58, which is secured within the interior of the body 20, and the second face 52 of the plunger 36. The purpose of the plunger return spring 56 is to urge the plunger 36 from a second dispensing position, as shown in FIG. 2, to the first at rest position as shown in FIG. 1. Thus, under the urging of the first return spring 56 which acts against the second face 52 of the plunger 36, the shaft 34 and the plunger 36 are returned to the first rest position, which they will assume when the dispenser apparatus is not being employed to dispense medical grade ultrasound gel.

There is a freely moving sealing plate 60 that is mounted for longitudinal movement along the shaft 34, between a first position where it is adjacent the second face 52 of the plunger 36, and a second position which is remote from the first position; the second sealing plate position being, of course, below the second face of the plunger 36 towards the dispensing opening 26 of the body 20.

There is also a sealing plate return spring 62 which is mounted withing the body 20, and it extends between a second fixed return spring seat 64 that is secured within the interior of the body 20, and a second face 66 of the sealing plate 60. Obviously, the second face 66 of the sealing plate 60 is remote from the second face 52 of the plunger 36.

Once again, the sealing plate return spring 62 is adapted to urge the sealing plate 60 from its second position near the second fixed return spring seat 64 to the first position adjacent the second face 52 of the plunger 36. The second and first positions of the sealing plate 60 are seen in FIGS. 2 and 1, respectively.

The sealing plate is adapted to cover the at least one passageway 54 that is formed in the plunger 36, when the sealing plate 60 is urged into its first position adjacent the second face 52 of the plunger 36.

As seen in FIG. 1, the height and position of the plunger 36 are such that, when it is in its first rest position, it covers the inlet opening 30.

Trigger means 70 are provided, which are adapted to move the shaft 34 and the plunger 36 from their first position as seen in FIG. 1 to the second position as seen in FIG. 2. It is clear, especially from FIG. 2, that when the trigger means is depressed so as to move the shaft 34 and the plunger 36 to its second position as seen in FIG. 2, it acts against the return springs 56 and 62.

It is also clear from FIG. 2 that the valve element 44 has been moved into its dispensing position away from the dispensing opening 26.

The manner of operation of the dispensing apparatus will now be discussed. First, it will be assumed that the entire interior of the body 20 has been filled, or primed, with uncontaminated medical grade ultrasound gel. This is accomplished by depressing the trigger 70, thereby moving the plunger 36 below the inlet opening 30, and thereby permitting the pressurized ultrasound gel to flow from the source of pressurized gel through the conduit 32, past the inlet opening 30 and into the chamber 40. The gel will then flow through the passageways 54, and because it is pressurized it will depress the return spring 62 and in any event it will extrude its way around the edges of the sealing plate 60 so as to fill the chamber 42. This procedure is a priming procedure, and occurs only once.

Thereafter, the dispenser apparatus is ready for use, in the following manner.

As seen in FIG. 1, when the shaft 34 and plunger 36 are in their rest position, the inlet opening 30 is covered, and therefore the medical grade ultrasound gel within the chamber 42 is essentially unpressurized. The sealing plate 60 is urged into its first position adjacent the second face 52 of the plunger 36; and the valve element 44 is in a closing position whereby the dispensing opening 26 is closed.

When the trigger 70 is depressed so as to push the shaft 34 and plunger 36 into the second position which is shown in FIG. 2, then it will be seen that an amount of ultrasound gel will flow from the interior of the body 20 through the dispensing opening 26, past and around the distal end of the shaft 34. The amount which is dispensed is a function of how much the trigger 70 has been depressed; in other words, the length of the stroke which has been taken. However, at the same time, the inlet opening 30 has been opened, and thus ultrasound gel will flow from the pressurized source thereof (not shown) into the chamber 40. When the depression of the trigger 70 has been released, then the action of the return spring 56 will urge the plunger 36 and the shaft 34 to which it is secured upwardly towards the first position. At that time, the ultrasound gel which is in the chamber 40 will flow through the passageways 54 towards the chamber 42. Since the sealing plate 60 is freely moving on the shaft 34, the pressure of the ultrasound gel moving through the passageways 54 will push against the return spring 62 so that the gel will pass around the edges of the sealing plate 60 into the chamber 42. It will be recalled that the chamber 42 is essentially unpressurized at this stage, so there is little resistance to the movement of the ultrasound gel from the chamber 40 into the chamber 42.

Thus, replenishment of the supply of uncontaminated ultrasound gel into the chamber 42 is assured.

Typically, appropriate seals such as that shown at 72 are provided to preclude leakage of the uncontaminated medical grade ultrasound gel from the chamber 40 past the shaft 34.

As noted, there may be one passageway 54 formed through the plunger 36, but typically there is a plurality of passageways. In any event, the sealing plate 60 is adapted to cover all of the passageways 54, so that when the trigger 70 is depressed there will be no chance for the ultrasound gel within the chamber 42 to recede backwards through the passageways 54 into the chamber 40.

Typically, the body 20 is configured at its second end 24 in the manner shown in FIGS. 1 and 2, so as to have an outwardly directed protrusion 74 through which the medical grade ultrasound gel will be dispensed when the valve element 44 is moved into its dispensing position.

A particular optional feature of the present invention, and one which assures the preclusion of cross-contamination, is the provision of a cap member 80 which has two axially located open ends 82 and 84 which are axially located in the cap, opposite each other. The cap member 80 is separable from the body 20, and is adapted to be fitted over the outwardly directed protrusion 74. Thus, as seen particularly in FIG. 2, the medical grade ultrasound gel from the chamber 42 is dispensed through the cap member 80 when the valve element 44 is moved into its dispensing position.

The outwardly directed protrusion 74 may be provided with exterior threads 86, and the cap member 80 may be provided with interior threads 88. The threads 86 and 88 cooperate with each other so that the cap member 80 may be threadably secured to the outwardly directed protrusion 74 of the body member 20.

Otherwise, it is possible to design the protrusion 74 and the cap member 80 so that the cap member may be snap fitted to the outwardly directed protrusion 74.

There are typically a pair of sealing rings 90 which are fitted to the outside periphery of the plunger 36. As seen particularly in FIG. 1, when the shaft 34 and the plunger 36 are in their first, rest position, one of the sealing rings 90 is positioned above the inlet opening 30, and the other of the sealing rings 90 is positioned below the inlet opening 30.

It has been noted that typically the source of pressurized medical grade ultrasound gel (not shown) is pressurized to be within the range of 40 psi t 100 psi.

A check valve 92 may be installed in the conduit 32, so as to preclude outflow of the ultrasound gel within the chamber 40 through the inlet opening 30 as the plunger 36 is returned to its first, rest position under the action of the return spring 56.

A gel warmer fitment 94 may be provided. The gel warmer fitment 94 is adapted to receive the outwardly directed protrusion 74, or it may receive the outwardly directed protrusion 74 together with a cap member 80. In any event, the gel warmer fitment 94 is heated so as to transfer heat from the gel warmer fitment 94 into the medical grade ultrasound gel at least within the chamber 42 in the region of the dispensing opening 26. The gel warmer fitment 94 may be thermostatically controlled so as to assure that the temperature of the ultrasound gel is in the region of body temperature, or slightly above. Thus, the patient and the medical technician or doctor administering the ultrasound procedure are both assured that there will be no shock to the patient by dispensing ultrasound gel which is at ambient or room temperature—typically, considerably below body temperature.

Moreover, an insulating layer 96 may be provided for the body 20 so as to surround the outer wall of the body 20, both so as to assure limited loss of heat from the warmed gel within the chamber 42, as well as to protect the hand of the medical technician or doctor who is manipulating the dispenser apparatus over the body of the patient.

It should be evident that the precise nature of the trigger 70 is beyond the scope of the present invention. The trigger may be such as to be manually manipulated, such as by being pressed against by the thumb or palm of the hand; or it may be a mechanically, electrically, hydraulically, or pneumatically activated plunger affixed to the shaft 34 at the exterior of the body 20.

The details of the assembly of the body 20 are outside the scope of the present invention. Typically, the body is a split sleeve having upper and lower halves which are threadably fitted one to the other, after the interior components thereof have been assembled.

The gel warmer fitment may, of course, be electrical or steam operated, as will be evident to those skilled in the art. Also, the nature of the cap members 80 is that they are typically injection molded from a suitable surgical grade of moldable plastics material. However, it will be appreciated that the unit cost of such cap members is very low, thereby contributing to the economy of use of an ultrasound gel dispensing apparatus in keeping with the present invention.

While the body had been described as being generally cylindrical, suggesting therefore that a cross-section is circular, it is evident that other cross-sectional shapes can be accommodated as well.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

What is claimed is:

1. A dispenser apparatus for dispensing medical grade ultrasound gel onto the body of a patient in a region which is to undergo ultrasound examination, said dispenser apparatus comprising:

a generally cylindrical body having a closed first end and a distal second end having a dispensing opening therein, and a cylinder axis extending along its length;

an inlet opening into the interior of said body near said first end thereof, said inlet opening being in fluid communication with a source of pressurized medical grade ultrasound gel;

an elongated shaft extending along the cylinder axis, and having a plunger secured thereto near a first end thereof, so as to be located near said first end of said body;

a valve element at a second end of said shaft, and adapted to close said dispensing opening when said shaft is in a first, at rest position, and to be in a dispensing position away from said dispensing opening when said shaft is in a second, dispensing position;

said plunger having a first face facing said first end of said body, and a second face facing said dispensing opening, and having at least one passageway formed therein and extending through the height of said plunger from said first face to said second face;

a plunger return spring mounted within said body and extending between a fixed first spring seat secured within the interior of said body and said second face of said plunger, said plunger return spring being adapted to urge said plunger from a second position when said shaft is in said second dispensing position towards a first position whereby said shaft and said plunger secured thereto will assume said first rest position;

a freely moving sealing plate mounted for longitudinal movement along said shaft between a first position adjacent said second face of said plunger and a second position remote therefrom, said second sealing plate position being below and adjacent to said second face of said plunger;

a sealing plate return spring mounted within said body and extending between a second fixed return spring seat secured within the interior of said body and a second face of said sealing plate remote from said second face of said plunger, said sealing plate return spring being adapted to urge said sealing plate from a second position near said second fixed return spring seat towards a first position adjacent said second face of said plunger;

said sealing plate being adapted to cover said at least one passageway formed in said plunger when said sealing plate is urged into its first position adjacent said second face of said plunger;

said plunger being adapted to cover said inlet opening when said plunger is in said first position; and trigger means adapted to move said shaft and said plunger from said first position thereof to said second position against said plunger return spring and said sealing plate return spring, whereby said valve element is moved into said dispensing position away from said dispensing opening.

2. The dispensing apparatus of claim 1, wherein a plurality of passageways is formed through said plunger from the first face to the second face thereof; and wherein said sealing plate is adapted to cover said plurality of passageways when it is urged into its first position adjacent said second face of said plunger.

3. The dispensing apparatus of claim 1, wherein said second end of said body is configured so as to have an outwardly directed protrusion through which medical grade ultrasound gel is dispensed when said valve element is moved into its dispensing position.

4. The dispensing apparatus of claim 3, further including a cap member having two axially located open ends opposite each other, said cap member being separable from said body, and adapted to be fitted to said outwardly directed protrusion;

whereby medical grade ultrasound gel is dispensed through said cap member when said valve element is moved into it's dispensing position.

5. The dispensing apparatus of claim 4, wherein said cap member is adapted to be threadably secured to said outwardly directed protrusion by cooperating threads formed exteriorly on said protrusion and interiorly on said cap member.

6. The dispensing apparatus of claim 4, wherein said cap member is adapted to be snap fitted to said outwardly directed protrusion.

7. The dispensing apparatus of claim 3, further including a gel warmer fitment which is adapted to receive said outwardly directed protrusion so as to transfer heat from said warmer fitment into said medical grade ultrasound gel at least within said body in the region of said dispensing opening.

8. The dispensing apparatus of claim 7, further including an insulating layer surrounding said body.

9. The dispensing apparatus of claim 1, wherein a pair of sealing rings is fitted to the outside periphery of said plunger; and wherein one of said sealing rings is positioned above said inlet opening and the other of said sealing rings is positioned below said inlet opening when said plunger is in its first, rest position.

10. The dispensing apparatus of claim 1, wherein said inlet opening is adapted for fluid communication with a source of pressurized medical grade ultrasound gel which is pressurized to within the range of 40 psi to 100 psi.

11. The dispensing apparatus of claim 1, further including a check valve installed in a fluid conduit extending from said inlet opening to a source of pressurized medical grade ultrasound gel, whereby outflow of ultrasound gel through said inlet opening is precluded.

* * * * *